US009731920B2

(12) United States Patent
Noguchi

(10) Patent No.: US 9,731,920 B2
(45) Date of Patent: Aug. 15, 2017

(54) MEDIA CONVEYANCE DEVICE, PRINTING DEVICE, AND MEDIA CONVEYANCE METHOD

(75) Inventor: Akihiko Noguchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 630 days.

(21) Appl. No.: 13/585,507

(22) Filed: Aug. 14, 2012

(65) Prior Publication Data

US 2013/0042807 A1 Feb. 21, 2013

(30) Foreign Application Priority Data

Aug. 17, 2011 (JP) ..... 2011-178262
Aug. 17, 2011 (JP) ..... 2011-178263

(51) Int. Cl.
*B65H 18/10* (2006.01)

(52) U.S. Cl.
CPC ..... *B65H 18/10* (2013.01); *B65H 2301/121* (2013.01); *B65H 2403/942* (2013.01); *B65H 2404/144* (2013.01); *B65H 2511/114* (2013.01); *B65H 2511/142* (2013.01); *B65H 2513/11* (2013.01); *B65H 2513/114* (2013.01); *B65H 2553/51* (2013.01); *B65H 2557/24* (2013.01); *B65H 2801/12* (2013.01)

(58) Field of Classification Search
CPC ..... B65H 18/10; B65H 2301/121; B65H 2801/12; B65H 2557/24; B65H 2553/51; B65H 2403/942; B65H 2404/144; B65H 2511/114; B65H 2511/142; B65H 2513/11; B65H 2513/114; B65H 2220/03; B65H 2220/02
USPC ..... 242/563, 564, 564.3, 564.4, 563.2
See application file for complete search history.

(56) References Cited

U.S. PATENT DOCUMENTS 2,496,977 A * 2/1950 Bechle ..... 474/23
2,846,161 A * 8/1958 Becker ..... 242/415.1
3,182,924 A * 5/1965 Jones et al. ..... 242/545.1
3,913,866 A * 10/1975 Hankins ..... 242/334.4
3,974,976 A * 8/1976 Mukai et al. ..... 242/420.1
4,012,674 A * 3/1977 Spitsbergen et al. ..... 318/7
4,049,095 A * 9/1977 Montalvo, Sr. ..... 192/3.51
(Continued)

FOREIGN PATENT DOCUMENTS

JP 08-164644 A 6/1996
JP 10-147463 A 6/1998
(Continued)

*Primary Examiner* — William A Rivera
(74) *Attorney, Agent, or Firm* — Foley & Lardner LLP

(57) ABSTRACT

A conveyance device holds a sheet medium in a roll and includes a drive roller that feeds the sheet medium from the roll to a conveyance path; and a roll rotating unit that rotates the roll forward to convey the sheet medium toward the drive roller and in reverse to rewind the sheet medium and that has multiple drive modes with different speeds of rotation. A control unit controls driving the drive roller and the roll rotating unit, such that, when starting a reverse conveyance operation that rewinds the sheet medium, the control unit selects the drive mode to be used in the reverse conveyance operation based on a first conveyance distance, which is the distance the sheet medium is to be conveyed in the reverse conveyance operation, and the diameter of the roll stored as roll diameter information and as calculated after an immediately previous reverse conveyance operation.

13 Claims, 6 Drawing Sheets

(56) References Cited

U.S. PATENT DOCUMENTS 4,361,029 A * 11/1982 Platter ..... 73/37.7
4,925,121 A * 5/1990 Tapscott ..... B65H 26/06 101/484
5,758,840 A * 6/1998 Murakami ..... 242/415
5,967,445 A * 10/1999 Yuyama ..... B65H 16/04 242/421.1
6,793,169 B2 * 9/2004 Fujiwara ..... B65H 18/10 242/530.1
6,807,998 B2 * 10/2004 Dods ..... B65C 9/1884 156/361
7,083,137 B2 * 8/2006 Watanabe et al. ..... 242/530.3
7,257,364 B2 * 8/2007 Ishikawa ..... 399/387
7,971,953 B2 * 7/2011 Ishii et al. ..... 347/16
8,167,228 B2 * 5/2012 Kobayashi ..... B41J 15/04 242/418
8,770,874 B2 * 7/2014 McNestry et al. ..... 400/236
2001/0011665 A1 * 8/2001 Hirose ..... B41F 13/004 226/40
2004/0189784 A1 9/2004 Mogi
2005/0129437 A1 6/2005 Ishikawa
2007/0145178 A1 * 6/2007 Fischer ..... B41F 13/03 242/532
2008/0048060 A1 * 2/2008 Kessler ..... B65C 9/1803 242/417.1
2008/0239052 A1 * 10/2008 Ishii ..... B41J 11/0075 347/104
2009/0016797 A1 * 1/2009 Brugue ..... B41J 15/16 400/613
2009/0121423 A1 5/2009 Nakamura et al.
2009/0283565 A1 * 11/2009 Ibanez ..... B65H 26/06 226/10
2009/0297244 A1 * 12/2009 Hatada ..... B41J 11/42 400/582
2010/0327515 A1 * 12/2010 Nakada et al. ..... 271/225
2011/0135372 A1 6/2011 Sato et al.
2011/0246127 A1 * 10/2011 Schnabel et al. ..... 702/145
2011/0295429 A1 * 12/2011 Schultze et al. ..... 700/275

FOREIGN PATENT DOCUMENTS

JP 10-181972 7/1998
JP 2000-171235 A 6/2000
JP 2003-048348 A 2/2003
JP 2004-245999 A 9/2004
JP 2005-225176 A 8/2005
JP 2008-254826 A 10/2008
JP 2008-273655 A 11/2008
JP 2010-069843 A 4/2010
JP 2010-111057 A 5/2010
TW 200528279 9/2005

* cited by examiner

| DRIVE MODE | MOTOR SPEED [rpm] | DRIVABLE DISTANCE [EP] | ACCELERATION/DECELERATION DISTANCE [EP] |
|---|---|---|---|
| RS1 | 3400 | 682 | 681 |
| RS2 | 2900 | 582 | 581 |
| RS3 | 2500 | 502 | 501 |
| RS4 | 2100 | 422 | 421 |
| RS5 | 1800 | 362 | 361 |
| RS6 | 1600 | 322 | 321 |
| RS7 | 1400 | 282 | 281 |
| RS8 | 1200 | 242 | 241 |

FIG. 2

[inch]

[mm]

| L \ D | 3.0 | 3.1 | 3.2 | ..... | 6.2 | 6.3 |
|---|---|---|---|---|---|---|
| 200 | RS1 | RS1 | RS2 | ..... | RS3 | RS4 |
| 190 | RS1 | RS1 | RS2 | ..... | RS3 | RS4 |
| 180 | RS1 | RS1 | RS2 | ..... | RS4 | RS4 |
| ⋮ | ⋮ | ⋮ | ⋮ | ⋱ | ⋮ | ⋮ |
| 100 | RS2 | RS3 | RS4 | ..... | RS7 | RS8 |
| ⋮ | ⋮ | ⋮ | ⋮ | ..... | ⋮ | ⋮ |

FIG. 3

MEDIA CONVEYANCE DEVICE, PRINTING DEVICE, AND MEDIA CONVEYANCE METHOD

CROSS-REFERENCE TO RELATED APPLICATION(S)

This application claims priority under 35 U.S.C. §119 on Japanese application nos. 2011-178262 and 2011-178263, each filed on Aug. 17, 2011. The content of each such application is incorporated herein by reference.

BACKGROUND

1. Technical Field

The present invention relates to conveyance devices for sheet media stored in a roll, and relates more particularly to media conveyance devices that can quickly select the appropriate drive mode for a roll rotating unit to convey the sheet medium in reverse.

2. Related Art

Receipt printers and other devices that use sheet media (such as paper) stored in a roll have a device for conveying the media to a processing position. The conveyance device usually has a drive roller that feeds the media from the roll to the conveyance path, and a roll rotating device that rewinds the conveyed media. The media is conveyed forward and reverse by driving these rollers.

The amount of media held in the roll, that is, the diameter of the roll, changes as the media is conveyed and consumed, and the load on the conveyance operation therefore changes. The roll diameter must therefore be known and reflected in the conveyance operation in order to accurately control media conveyance. Accurately determining the roll diameter is particularly important when the media is rewound by driving the roll rotating device because the conveyance speed is determined by the roll diameter.

Methods that determine the initial roll diameter by performing a special operation to measure the roll diameter during the device initialization process and then estimate the roll diameter thereafter based on media conveyance distance and media thickness (paper thickness) information are known from the literature.

Japanese Unexamined Patent Appl. Pub. JP-A-2008-254826 is directed to a method of detecting how much roll paper remains while rewinding the roll paper in a roll paper recording device. Japanese Unexamined Patent Appl. Pub. JP-A-H 10-147463 is directed to using the roll diameter for conveyance control in a compact web winding device that constantly maintains optimum tension and prevents media slack and biasing.

A problem with the roll diameter estimation method of the related art is that extra time is required for the special operation described above. Moreover, the estimated roll diameter is not very accurate due to error in the measured conveyance distance and variation in the media thickness.

The roll diameter is acquired in the process of measuring the remaining amount of roll paper in the method described in JP-A-2008-254826, but this value is acquired during the reverse conveyance operation. Because using the correct roll diameter is particularly important for controlling conveyance in reverse as described above, the actual current roll diameter is preferably acquired before reverse conveyance starts. However, the value from the previous reverse conveyance operation must be used if the roll diameter is acquired during reverse conveyance, and because the media is typically conveyed forward after being reversed, the actual roll diameter of the previous reverse conveyance operation cannot be accurately used for the next reverse conveyance operation.

Conveyance devices such as described above also typically have a number of different drive modes in which the drive units operate at different (rotational) speeds. The desirable mode is preferably selected appropriately according to the conveyance requirements.

When selecting and setting the drive mode, the diameter of the drive rollers is constant and the appropriate drive mode can be determined relatively easily. However, because the conveyance speed of the roll rotating device described above varies according to the constantly changing diameter of the media roll and the relationship between the different drive units must also be considered, determining the appropriate drive mode becomes a complicated process.

SUMMARY

A conveyance device according to the present invention can quickly and appropriately select the drive mode of a roll rotating unit used for reverse conveyance of sheet media stored in a roll.

A conveyance device for sheet media stored in a roll according to another aspect of the present invention can accurately determine the roll diameter required for conveyance control without requiring extra time.

Accordingly, a first aspect of the invention entails a conveyance device that holds a sheet medium in a roll. The conveyance device comprises a drive roller that feeds the sheet medium from the roll to a conveyance path; and a roll rotating unit that rotates the roll forward to convey sheet medium toward the driver roller and in reverse to rewind the sheet medium, the roll rotating unit having multiple drive modes with different speeds of rotation respectively. A control unit of the conveyance device controls driving the drive roller and the roll rotating unit, such that, when starting a reverse conveyance operation that rewinds the sheet medium, the control unit selects the drive mode to be used in the reverse conveyance operation from among the multiple drive modes based on a first conveyance distance, which is the distance the sheet medium is to be conveyed in the reverse conveyance operation and the diameter of the roll stored as roll diameter information and as calculated after an immediately previous reverse conveyance operation.

Preferably, the drive mode is selected so that a first condition, which is that the first conveyance distance is greater than a second conveyance distance, which is the total distance the sheet medium is conveyed both during acceleration and during deceleration of the roll rotating unit in the selected drive mode, is satisfied.

Preferably, the drive mode is selected so that a second condition is also satisfied. The second condition is that the conveyance speed of the roll rotating unit is lower than a conveyance speed of the drive roller in the selected drive mode.

Preferably, from among the drive modes satisfying the first and second conditions, the drive mode with the highest speed of rotation is selected and set as the drive mode to be used.

Preferably, drive mode selection information correlating the selected drive mode to the first conveyance distance and currently stored roll diameter information is stored, and the drive mode selection information is referenced to determine the drive mode.

Preferably, the conveyance device also has a first rotation detection unit disposed to the drive roller and a second rotation detection unit disposed to the roll rotating unit. The control unit calculates the roll diameter based on values output by the first and second rotation detection units during a specific period in a forward conveyance operation, and stores the calculated roll diameter as the roll diameter information.

Preferably, the process of calculating the roll diameter and storing the roll diameter information involves executing the steps of calculating the roll diameter based on values detected by the first and second rotation detection units during the specific period, after the second rotation detection unit detects rotation after the forward conveyance operation starts, or after conveyance of a predetermined conveyance distance. Thereafter, the stored roll diameter information is updated with the just-calculated roll diameter.

Preferably, an error process is executed when the roll diameter calculated in a current specific period is greater than the roll diameter calculated in a previous specific period or is not in a predetermined tolerance range.

Another aspect of the invention is a printing device including the conveyance device described in any of the foregoing aspects of the invention, and means for printing on the conveyed sheet medium.

Another aspect of the invention is a conveyance method of a conveyance device that holds a sheet medium in a roll and has a drive roller that feeds the sheet medium from the roll to a conveyance path, and a roll rotating unit that rotates the roll forward to convey the sheet medium toward the drive roller and in reverse to rewind the sheet medium. The roll rotating unit has multiple drive modes with different speeds of rotation respectively. A control unit controls driving the drive roller and the roll rotating unit as described above.

The drive mode with the highest speed of rotation is preferably selected from among the drive modes satisfying the first and second conditions described above and set as the drive mode to be used.

Further preferably, drive mode selection information correlating the selected drive mode to the first conveyance distance and currently stored roll diameter information, and this drive mode selection information is referenced to determine the drive mode.

Further preferably, the conveyance device also has a first rotation detection unit disposed to the drive roller and a second rotation detect ion unit disposed to the roll rotating unit. The control unit calculates the roll diameter as described above.

Further preferably, the process of calculating the roll diameter and storing the roll diameter information involves executing the steps described above.

Further preferably, an error process is executed when the roll diameter calculated in a current specific period is greater than the roll diameter calculated in a previous specific period or is not in a predetermined tolerance range.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 2 shows examples of the drive modes of the roll rotating unit 36.

FIG. 3 shows an example of a drive mode selection table.

DESCRIPTION OF EMBODIMENTS

Figure 1:
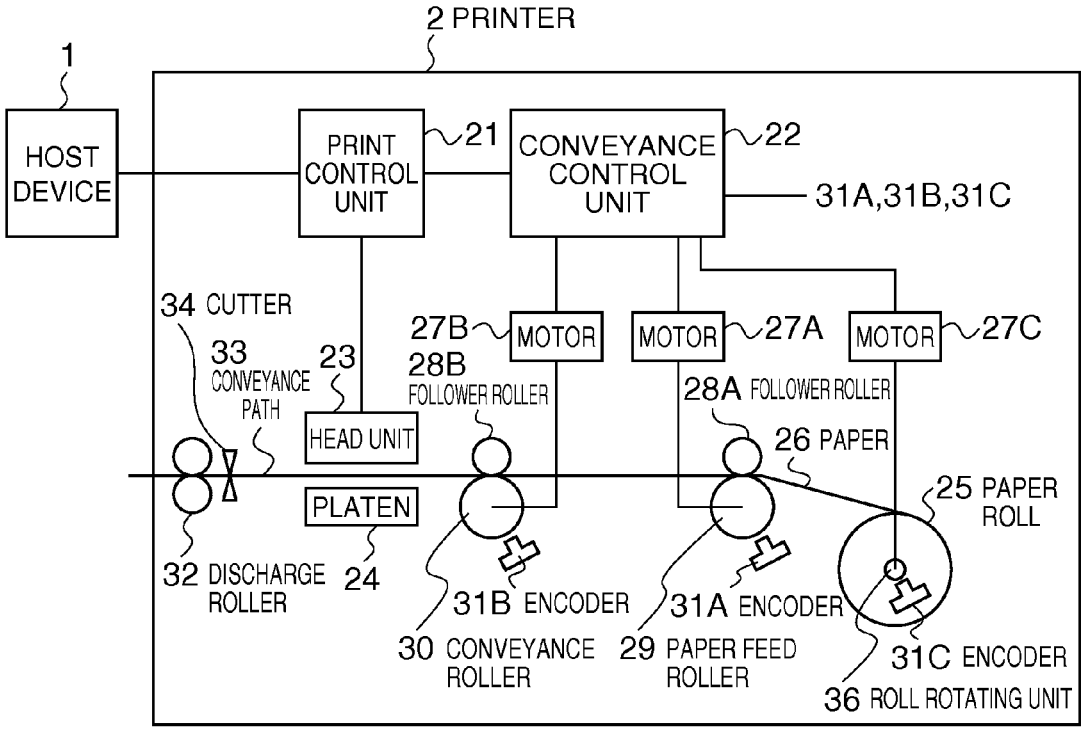
FIG. 1 is a block diagram of a preferred embodiment of a printing device having a conveyance device according to the invention.

A preferred embodiment of the present invention is described below with reference to the accompanying figures. It will be obvious that the scope of the invention is not limited by the embodiment described below. Note also that identical or similar parts are described using the same reference numerals or symbols in the accompanying figures.

FIG. 1 is a block diagram of a preferred embodiment of a printer having a conveyance device according to the invention. The printer 2 shown in FIG. 1 is a printing device according to this embodiment of the invention, and this printing device executes a printing process that conveys paper 26 stored in a roll 25 forward using a paper feed roller 29 (drive roller) and conveyance roller 30 and prints at a printing position.

The printer also performs a rewinding operation that conveys the media in reverse between jobs and rewinds the paper 26 to a specific position by driving the paper feed roller 29 and roll rotating unit 36. The conveyance system of this printer is also configured to quickly and appropriately determine the drive mode of the roll rotating unit 36 used in the rewinding operation based on the required conveyance distance and roll diameter at that time.

The conveyance device of the printer also determines and stores the diameter of the paper roll 25 based on paper feed roller 29 and roll rotating unit 36 rotation information acquired at a specific time during forward conveyance, and uses this value to control the next reverse conveyance operation. The current roll diameter can therefore be accurately determined without requiring additional operating time to get the roll diameter, and conveyance can be accurately controlled based on this value.

As shown in FIG. 1, the printer 2 is a device that receives commands from a computer or other host device 1 and executes a printing process, and in this embodiment is a printing device that uses paper 26 held in a roll 25 and prints continuously while conveying the paper 26.

FIG. 1 schematically describes the configuration of the printer 2. This printer 2 has a printing system that controls print content and executes the printing process on the paper 26, and a conveyance system that conveys the paper 26.

A print control unit 21 is disposed to the printing system. The print control unit 21 receives printing instructions from the host device 1, and sends print commands to the head unit 23 and sends conveyance requests to the conveyance control unit 22 of the conveyance system to convey the paper 26 according the received instructions. The head unit 23 prints on the paper 26 moving at a specific speed between the head unit 23 and platen 24 according to the print commands.

As shown in FIG. 1, the conveyance system performs an operation that continuously conveys the paper 26, which is held in a roll 25 in the print medium storage location, forward (downstream) through the conveyance path 33, cuts the printed portion with the cutter 34, and discharges the cut portion from the printer 2 by means of a discharge roller 32. The conveyance system also performs a reversing operation in the opposite direction (upstream) after this conveyance operation so that the leading end of the paper 26 comes to a specific position (indexing position) on the upstream side of the head unit 23.

The conveyance system includes a paper feed roller 29 (upstream roller) and conveyance roller 30 (downstream roller) that are driven by corresponding motors (27A, 27B). Disposed opposite each of these rollers with the paper 26 therebetween is a follower roller (28A, 28B). Each follower roller can move perpendicularly to the surface of the paper 26, and can be set to two vertical positions. At the down position in contact with the paper 26, the follower rollers are urged with a downward perpendicular force to the surface of the paper 26, pressing the paper 26 with a force perpendicular to the paper 26 surface and holding the paper 26 with the opposing roller (29, 30). At the up position separated from the paper 26, the force holding the paper 26 is not applied.

A function of the paper feed roller 29 is to supply the paper 26 held in a roll 25 to the conveyance path 33. The paper feed roller 29 is driven by torque from the motor 27A transferred thereto through a speed reducer, and moves the paper 26 by the force of friction against the paper 26 pressed between the paper feed roller 29 and follower roller 28A. These rollers are also used when reversing the paper 26.

A function of the conveyance roller 30 is to convey the paper 26 supplied by the paper feed roller 29 to the printing position, or more specifically to the head unit 23 position. The conveyance roller 30 is turned by torque transferred thereto from the motor 27B through a speed reducer, and moves the paper 26 by the force of friction against the paper 26 held between the conveyance roller 30 and follower roller 28B.

An encoder 31A (first rotation detection unit), 31B is respectively disposed to the paper feed roller 29 and conveyance roller 30, and the values detected by the corresponding encoders are reported to the conveyance control unit 22. The encoders have a common configuration known from the literature, are disposed directly to the corresponding rollers 29, 30 or to the drive system (drive gear train) thereof, and output pulse signals to the conveyance control unit 22. The conveyance control unit 22 determines the number of rotations the rollers have turned and the conveyance speed of the rollers from the pulse signals received per unit time.

The conveyance system also includes the roll rotating unit 36. The roll rotating unit 36 performs an operation that rotates the paper 26 stored in a roll 25 and rewinds the paper 26 that was fed. The roll rotating unit 36 is driven by motor 27C, and includes a speed reducer (drive gear train) that transfers torque from the motor 27C, and a shaft that passes through the center of the paper roll 25 and is rotated by the torque transferred thereto through the speed reducer.

The roll rotating unit 36 has plural drive modes that differ by the speed of the motor 27C, and the drive mode appropriate to the conveyance operation is selected. Note that these drive modes and the method of selecting the drive mode are described in detail below.

An encoder 31C (second rotation detection unit) is also disposed to the roll rotating unit 36, and the values detected thereby are reported to the conveyance control unit 22. The specific configuration and function of encoders 31A and 31B are the same.

Next, the conveyance control unit 22 shown in FIG. 1 is the part that controls the conveyance system, and based on instructions from the print control unit 21 controls the paper 26 conveyance operation described above. More specifically, the conveyance control unit 22 controls driving and stopping the paper feed roller 29, conveyance roller 30, and roll rotating unit 36 to desirably convey the paper 26 forward and reverse.

The conveyance control unit 22 executes a process that determines the drive mode of the roll rotating unit 36 for reverse conveyance. This process is a feature of this printer 2, and is described more specifically below. The conveyance control unit 22 also executes a process that determines the diameter of the paper roll 25 as needed, and stores the latest roll diameter as roll diameter information. A method that calculates the roll diameter from the number of rotations of the paper feed roller 29 and paper roll 25 during the forward conveyance operation can be used in the process that determines the roll diameter.

While not shown in the figures, the conveyance control unit 22 includes a CPU, ROM, RAM, and NVRAM (non-volatile memory), and the foregoing process executed by the conveyance control unit 22 is executed by the CPU operating according to a program stored primarily in ROM.

Data required for processing is temporarily stored in RAM, which also stores the values detected by the encoders 31 that are required to control driving and stopping the paper feed roller 29, conveyance roller 30, and roll rotating unit 36. The roll diameter information of the roll 25 is also stored in RAM or NVRAM. The drive mode selection table (drive mode selection information) described above is also stored in ROM.

The conveyance system including the paper feed roller 29, conveyance roller 30, roll rotating unit 36 and conveyance control unit 22 is an example of a conveyance device according to the invention.

As described above, the printer 2 according to this embodiment of the invention conveys the paper 26 forward when printing and in reverse during rewinding, and is configured to perform the method of determining the drive mode of the drive unit used in each conveyance operation, and particularly the method of determining the drive mode of the roll rotating unit 36 during reverse conveyance. The printer 2 is further configured to perform a process of acquiring the roll 25 diameter information, for use in controlling these conveyance operations, particularly the reverse conveyance operation. These drive mode determination methods and the processes of acquiring the roll diameter are described in detail below.

The plural drive modes of the roll rotating unit 36 are described first. FIG. 2 shows examples of the roll rotating unit 36 drive modes. As shown in FIG. 2, there are eight drive modes RS1 to RS8 that differ by the speed of the motor 27C. The motor speed is fastest in drive mode RS1 and decreases sequentially as the drive mode number increases to drive mode RS8 in this embodiment.

As shown in FIG. 2, an acceleration/deceleration distance is defined for each drive mode. This acceleration/deceleration distance is the sum of the rotational distance (number of rotations) required to reach the rotational speed set for each mode, that is, the rotational distance (number of rotations) during acceleration, and the rotational distance (number of rotations) required to stop from this rotational speed, that is, the rotational distance (number of rotations) during deceleration, and is expressed by the number of encoder pulses (EP) detected by the encoder 31C.

Because the speed of rotation defined for each mode is used when that mode is selected, rotation (conveyance) at least equal to the acceleration/deceleration distance defined for that mode is required. The drive condition (condition for using a mode) is the drivable distance shown in FIG. 2, which is also expressed by the number of encoder pulses (EP) output by the encoder 31C.

Whether the conveyance distance of the conveyance operation satisfies this drivable distance must therefore first be checked in order to determine the drive mode of the roll rotating unit 36. Because information about the distance to be conveyed (the conveyance distance in millimeters, for example) is obtained from the print control unit 21 when starting the reverse conveyance operation, this distance is converted to an encoder pulse count (EP) based on the roll diameter acquired at that time from the roll diameter information, and whether this encoder pulse count (EP) equals or exceeds the drivable distance can be determined. Whether this conveyance distance is greater than or equal to the drivable distance is one condition for determining the drive mode.

A second condition for determining the drive mode is that the conveyance speed of the roll rotating unit 36 is slower than the conveyance speed of the paper feed roller 29. This condition is required because the printer 2 also drives the paper feed roller 29 during reverse conveyance, slipping between the paper feed roller 29 and the paper 26 is not desirable when the conveyance speed of the roll rotating unit 36 is greater than the speed of the paper feed roller 29, and the printer 2 conveys the paper 26 with slack between the paper feed roller 29 and roll 25.

As described above, this condition can be evaluated because the roll diameter is determined in real time and the conveyance speed of the roll rotating unit 36 in each drive mode can be calculated from the roll diameter, and the conveyance speed of the paper feed roller 29 is determined first according to the drive command from the print control unit 21.

The printer 2 then selects the drive mode that meets these two conditions and has the highest speed of rotation as the drive mode to use.

While the theory used to determine the drive mode of the roll rotating unit 36 is described above, the specific decision process is executed using methods such as described below.

One method uses previously stored drive mode selection tables and refers to these tables to determine the drive mode of the roll rotating unit 36. Because the specifications of the drive modes shown in FIG. 2 for example are predetermined, and the conveyance speed of the paper feed roller 29 can be determined from the device specifications if the conveyance distance is known, the two conditions described above can be evaluated if the conveyance distance and the roll 25 diameter are known, and the drive mode to be used can be determined according to the theory described above. The drive modes can therefore be predefined according to the conveyance distance and roll diameter values, and a predefined table correlating the conveyance distance and roll diameter to the drive mode to be selected is the drive mode selection table.

FIG. 3 shows an example of a drive mode selection table. In the example shown in FIG. 3, if the conveyance distance L of the conveyance command is 200 mm and the roll diameter D at that time is 3.0 in, the conveyance control unit 22 refers to the table and sets drive mode RS1 as the mode to use. If the conveyance distance L is 100 mm and the current roll diameter is 6.2 in, drive mode RS7 is selected. Note that if the conveyance distance L and roll diameter D are between the values defined in the drive mode selection table, the drive mode can be set by selecting the mode with the slower roller speed from among the drive modes defined for values above and below the conveyance distance L and roll diameter D.

Figure 4:
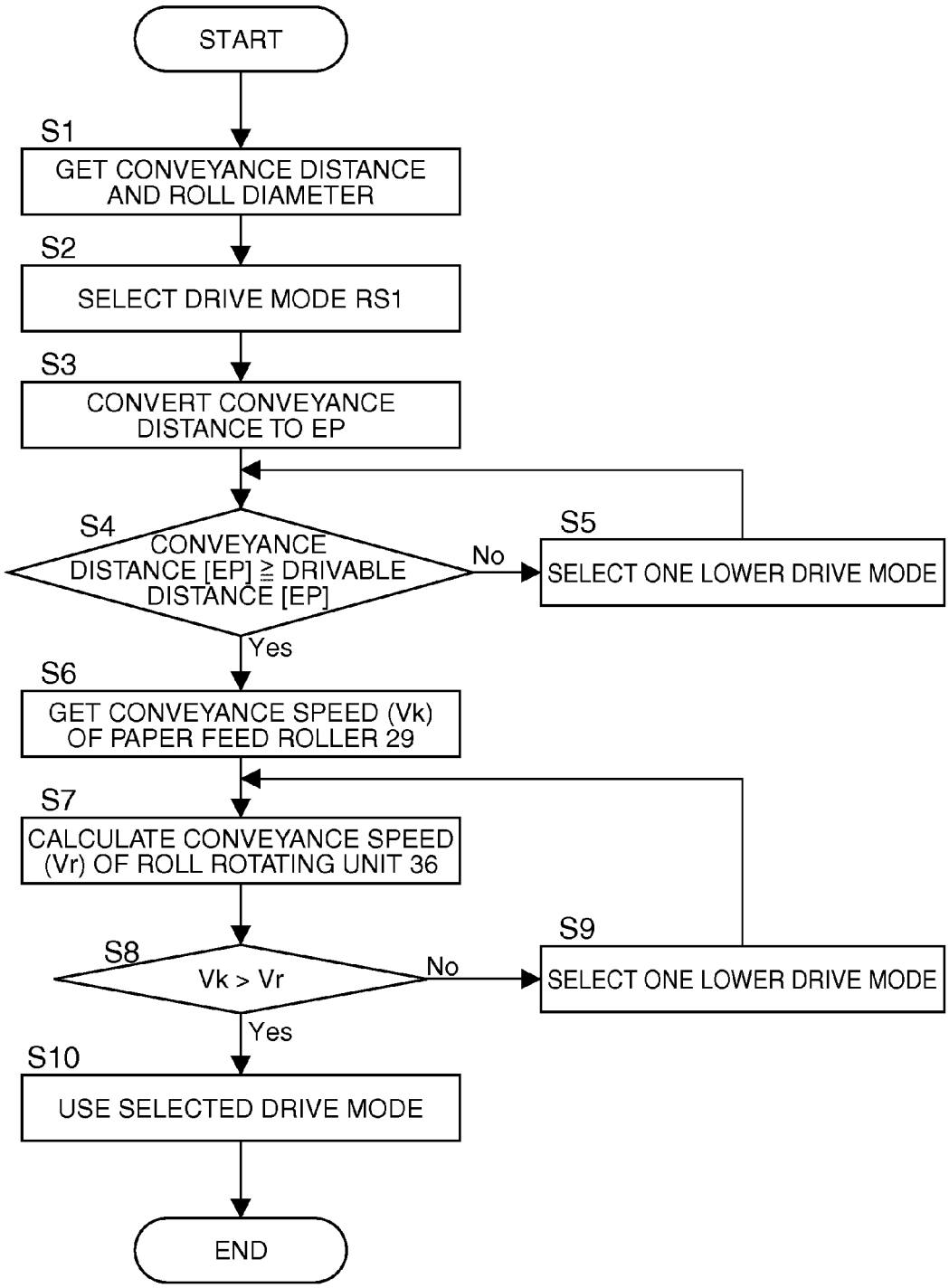
FIG. 4 is a flowchart of steps in a drive mode selection process according to embodiments of the invention.

A second method is a method whereby the conveyance control unit 22 runs a process that determines the mode to be used according to the theory described above when a reverse drive request is received. FIG. 4 is a flow chart showing steps in this drive mode selection process.

When a reverse conveyance command is received from the print control unit 21, the conveyance control unit 22 starts the drive mode selection process and gets the conveyance distance that the media must be conveyed in the conveyance operation of the received command and the roll diameter of the roll 25 at that time (step S1). The conveyance distance is acquired from content included in the conveyance command, and the roll diameter is acquired from the roll diameter information currently held in memory.

The conveyance control unit 22 then selects RS1 as the initial value of the roll rotating unit 36 drive mode (step S2). More specifically, the mode with the highest speed of rotation is selected.

The conveyance control unit 22 then converts the acquired conveyance distance to the encoder pulse count (EP) of the encoder 31C (step S3). This conversion is done by converting the conveyance amount (length) to the number of rotations of the roll 25 using the acquired current roll diameter, and converting this number of rotations to the EP value using a constant that is predetermined according to the device specifications.

The conveyance control unit 22 then checks the first condition described above. More specifically, the conveyance control unit 22 checks if the EP value determined for the conveyance distance is greater than or equal to the drivable distance of the EP value for the currently selected drive mode (step S4).

If this check determines that the conveyance distance is not greater than or equal to the drivable distance (step S4 returns No), the conveyance control unit 22 selects the next lower drive mode (the drive mode with the next lower speed of rotation) (step S5), and repeats the test of step S4. For example, if this condition is not satisfied when drive mode RS1 is selected, drive mode RS2 is selected and the process returns to step S4.

The drive mode continues to be lowered until the conveyance distance is determined to be greater than or equal to the drivable distance (step S4 returns Yes), that is, until the first condition is satisfied.

When the conveyance distance is greater than or equal to the drivable distance (step S4 returns Yes), the conveyance control unit 22 gets the conveyance speed (Vk) of the paper feed roller 29 determined for the received conveyance command (step S6) in order to evaluate the second condition described above.

Next, the conveyance control unit 22 calculates the conveyance speed (Vr) of the roll rotating unit 36 (step S7). More specifically, the speed of roll 25 rotation is determined by multiplying the motor speed (rotational speed) of the currently selected drive mode by a constant predetermined from the device specifications, and calculates the conveyance speed (Vr) from the speed of the roll 25 and the previously acquired roll diameter.

The conveyance control unit 22 then compares the acquired conveyance speed (Vk) with the calculated conveyance speed (Vr), and determines if the conveyance speed (Vk) is greater than conveyance speed (Vr) (step S8). More specifically, the second condition is evaluated.

If conveyance speed (Vk) is not greater than conveyance speed (Vr) (step S8 returns No), the conveyance control unit 22 selects the next lower drive mode (the drive mode with the next lower speed of rotation) (step S9), and then repeats step S7. Steps S9 and S7 repeat until conveyance speed (Vk) is greater than conveyance speed (Vr) (step S8 returns Yes). More specifically, the drive mode is lowered until the second condition is satisfied.

When conveyance speed (Vk) is greater than conveyance speed (Vr) (step S8 returns Yes), the conveyance control unit 22 sets the drive mode selected at that time as the drive mode to be used for the conveyance operation (step S10).

When the drive mode selection process ends, driving the roll rotating unit 36 starts in the selected drive mode.

The second condition described above, that is, whether the conveyance speed (Vr) of the roll rotating unit 36 is lower than the conveyance speed (Vk) of the paper feed roller 29, is used as the upper limit of the conveyance speed (Vr) of the roll rotating unit 36 to determine the drive mode in the process described above, but a predetermined speed range could be set and whether the conveyance speed (Vr) is within this speed range could be used instead of the second condition described above or in addition to the above second condition.

Figure 5:
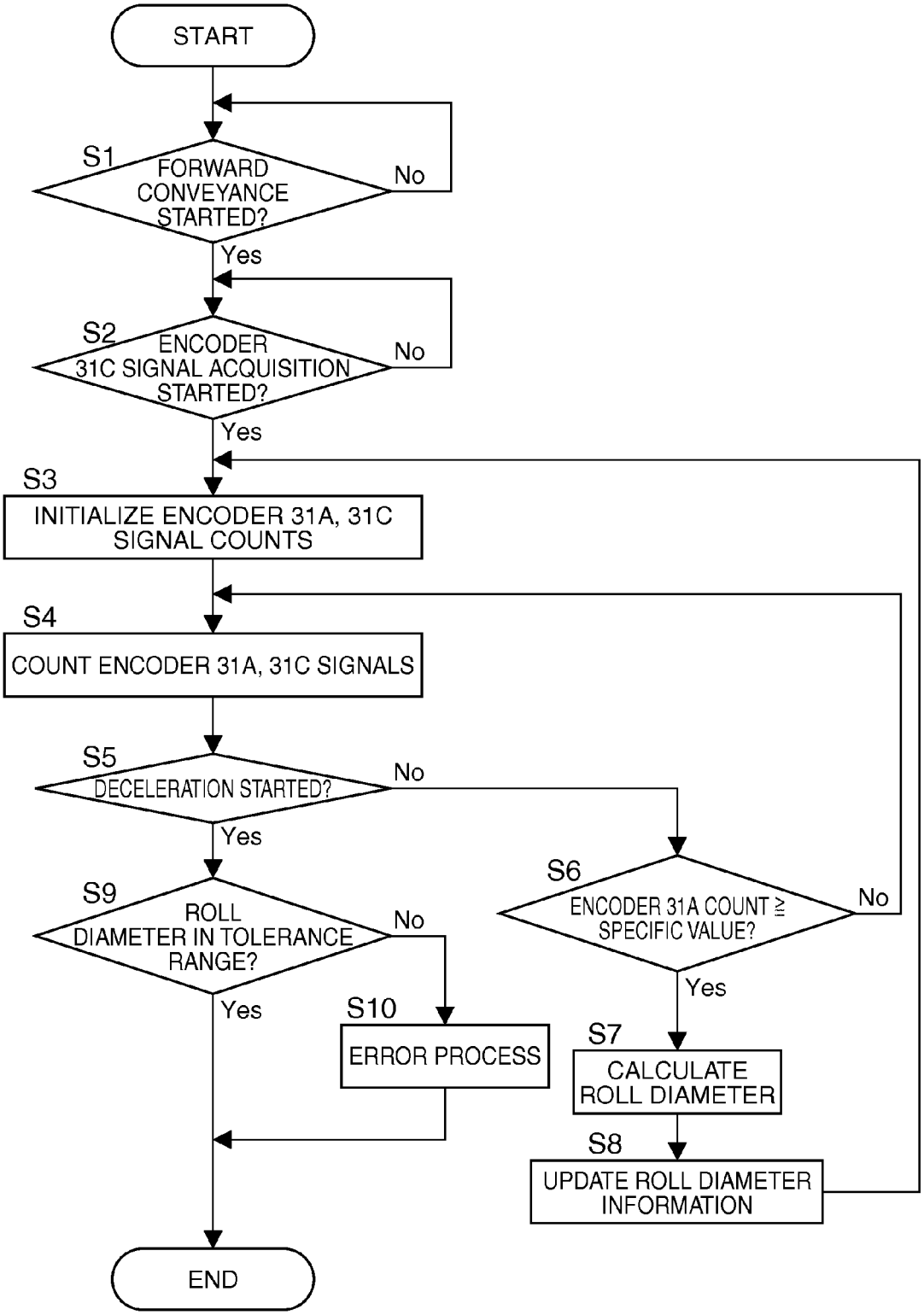
FIG. 5 is a flow chart of steps in a roll diameter acquisition process executed by a conveyance control unit 22.

FIG. 5 is a flow chart of steps in the roll diameter acquisition process executed by the conveyance control unit 22. The conveyance control unit 22 waits until a forward conveyance (forward rotation conveyance) command is output from the print control unit 21 and forward conveyance starts in response to the command (step S1 returns No). The roll diameter acquisition process is executed during forward conveyance.

When forward conveyance starts, that is, when driving the paper feed roller 29 and conveyance roller 30 starts (step S1 returns Yes), the conveyance control unit 22 waits to receive the pulse signal from the encoder 31C (step S2 returns No), that is, waits until the roll rotating unit 36 starts turning. If when forward conveyance starts there is slack in the paper 26 between the paper feed roller 29 and roll 25 or the paper wound on the roll 25 is loose, there will be no tension on the paper 26 immediately after the paper feed roller 29 turns, and the roll rotating unit 36 does not start turning immediately. Because the roll diameter cannot be calculated (estimated) during the period in which the roll rotating unit 36 is not turning, step S2 eliminates this period.

When the roll rotating unit 36 then starts turning and a pulse signal is received from the encoder 31C (step S2 returns Yes), the conveyance control unit 22 starts measuring the diameter of the roll 25.

Figure 6:
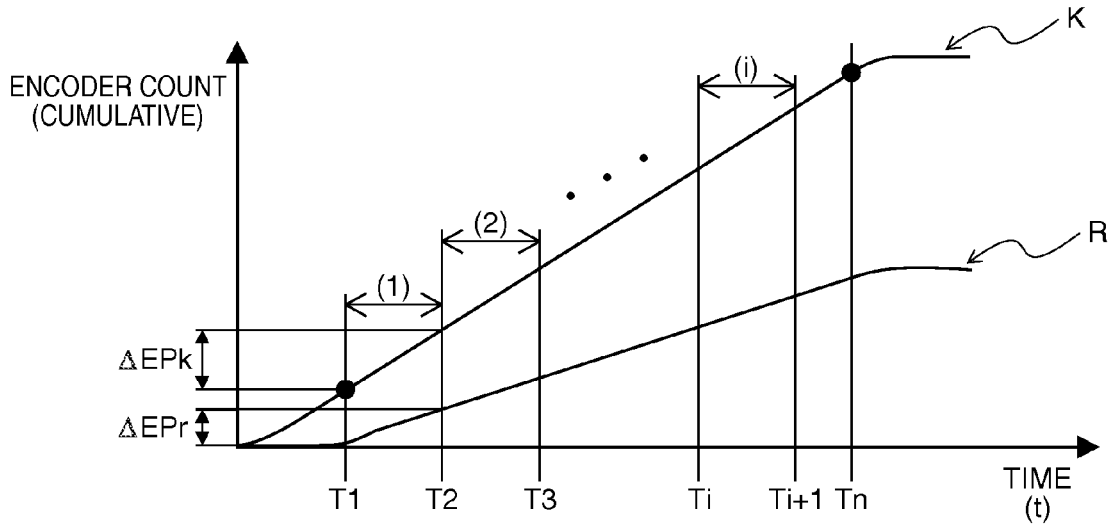
FIG. 6 graphically illustrates measuring the roll diameter.

FIG. 6 describes the roll diameter measurement process. FIG. 6 is a graph showing the count (cumulative) of the encoder pulse signal received by the conveyance control unit 22 over time from the start of forward conveyance. Curve K in the figure represents the cumulative count of the pulse signal received from encoder 31A, and curve R represents the cumulative count of the pulse signal received from encoder 31C. The roll rotating unit 36 starts turning at time T1 in the graph in FIG. 6. Measuring the roll diameter therefore starts from time T1.

The conveyance control unit 22 then initializes the pulse signal count (EPk) of encoder 31A, and the pulse signal count (EPr) of encoder 31C (step S3). More specifically, both counts are set to zero (EPk=0, EPr=0).

The conveyance control unit 22 thereafter counts the number of pulses received from encoder 31A and encoder 31C as counts EPk and EPr (step S4).

The conveyance control unit 22 then checks at a regular time interval if the forward conveyance operation that just started has started decelerating (step S5). If deceleration has not started (step S5 returns No), the conveyance control unit 22 checks if the count EPk of encoder 31A is a specific value or greater (step S6). This specific value is a preset value.

If count EPk is not greater than the specific value (step S6 returns No), control returns to step S4 and counting the pulse signal continues.

The same steps thus repeat, and when count EPk reaches or exceeds the specific value (step S6 returns Yes), the conveyance control unit 22 executes the roll diameter calculation process (step S7). This occurs at time T2 in FIG. 6, and the calculation process measures the roll diameter during period (1) in FIG. 6.

To calculate the roll diameter the conveyance control unit 22 first gets the current counts EPk and EPr. The conveyance control unit 22 then calculates the current roll diameter Dr using the following equation.

$$EPk \times Kk \times Dk \times = EPr \times Kr \times Dr \times$$

where Kk is a predetermined constant, and EPk×Kk is the number of rotations of the paper feed roller 29 since the count was initialized. Dk denotes the diameter of the paper feed roller 29, and this value is also a predetermined constant. The left side of the equation therefore denotes the number of rotations of the paper feed roller 29 times the circumference, that is, the conveyance distance (length) of the paper feed roller 29 since the count was initialized.

In the right side of the equation Kr is likewise a predetermined constant, and EPr×Kr is the number of rotations of the paper roll 25 since the count was initialized. Dr denotes the diameter of the roll 25, and this value changes according to paper 26 conveyance. The right side therefore likewise denotes the conveyance distance (length) of the roll 25 since the count was initialized.

Because the paper 26 is conveyed with no slack between the paper feed roller 29 and roll 25 as described above, the left and right sides of the equation will be equal, and if the acquired counts are substituted into the equation, the values other than Dr will be known and Dr can be determined.

The conveyance control unit 22 then stores the calculated roll diameter as the roll diameter information in RAM or NVRAM (step S8). The previously stored roll diameter information can be updated with the current information at this time, or the current value can be identifiably stored as the latest information. In the example shown in FIG. 6 the roll diameter is calculated in measurement period (1) and stored.

The process then returns to step S3, and the same steps repeat until forward conveyance starts decelerating. More specifically, the roll diameter at that time is calculated and stored each time count EPk reaches a specific value (or more). After the roll diameter is calculated in period (1) in the example in FIG. 6, the roll diameter is calculated again in measurement period (2), and is thereafter calculated repeatedly until period (i). Deceleration then starts in this example at time Tn.

When deceleration starts (step S5 returns Yes), the conveyance control unit 22 checks if the value of the most recent roll diameter information is within a specific tolerance range (step S9). The maximum roll diameter that can be loaded and conveyed in the printer 2, and the minimum roll diameter when the paper 26 becomes depleted, are known, and if the most recent roll diameter is not within this range (step S9 returns No), the conveyance control unit 22 executes an error handling process (step S10). This error handling process reports an error to the user and disables printing, for example. The value obtained in period (i) is checked in the example shown in FIG. 6.

The roll diameter may not be within this range when the actual roll diameter is not in this range or when the conditions for calculating the roll diameter based on the acquired counts are not satisfied. The conditions for calculating the roll diameter not being satisfied include when slipping occurs between the paper feed roller 29 and paper 26 and the number of paper feed roller 29 rotations is not correctly reflected in the paper 26 conveyance distance, and when slipping occurs between the roll 25 and spindle and the number of spindle rotations does not correctly indicate the number of rotations of the roll 25.

Because the latest roll diameter information is not correct when the error handling process is executed, the information is discarded and the roll diameter acquisition process ends.

If the latest roll diameter is within the tolerance range (step S9 returns Yes), the roll diameter acquisition process ends.

If the roll diameter acquisition process ends normally, the latest roll diameter information that was stored is used to control reverse conveyance the next time. More specifically, the roll diameter obtained (measured) immediately before deceleration starts in the current forward conveyance operation is used in the next reverse conveyance operation.

Note that the error checking and error handling processes of steps S9 and S10 can be performed each time the roll diameter is calculated. In this case, these steps are executed after step S7 in FIG. 5, and the roll diameter acquisition process ends if an error is returned.

If at the same time (after step S7) the calculated roll diameter is greater than the roll diameter calculated in the previous roll diameter acquisition process, the paper is not being correctly conveyed forward, and a similar error handling process can therefore be executed.

Calculating the roll diameter starts soon after forward conveyance starts in the roll diameter acquisition process described above, but because the roll diameter used for control thereafter is the value directly before deceleration starts, the start of roll diameter calculation could be delayed in order to reduce the processing load. In this case, the calculation process could start after the media is conveyed 70% of the scheduled conveyance distance, for example.

As described above, because the drive mode of the roll rotating unit 36 for driving reverse conveyance of the paper 26 is determined to satisfy required conditions based on correct information reflecting the roll diameter at that time, the printer 2 according to this embodiment of the invention can appropriately control reverse conveyance without creating a problem.

More specifically, the drive mode can be quickly determined, printer 2 throughput can be improved, and the control process can be simplified by using a method based on a previously stored drive mode selection table as described above.

In addition, problems resulting from paper jams or the conveyance speed becoming too slow can be suppressed by limiting the conveyance speed of the drive mode that is used to a specific speed or less.

Printer 2 throughput can also be improved because the mode with the greatest speed of rotation is selected from among the drive modes satisfying the required conditions.

The conveyance operation can al so be consistently control led using the latest information because the roll diameter information required for paper 26 conveyance control is measured and stored immediately before deceleration starts in each forward conveyance operation. More particularly, because reverse conveyance, which is greatly affected by the roll diameter, is normally immediately preceded by forward conveyance, reverse conveyance can be accurately controlled based on the newest accurate value. There is also little error because the roll diameter is calculated according to a formula directly from the detected encoder values. An accurate value can also be calculated because the calculation process is executed at a constant speed after the paper feed roller 29 and roll 25 are synchronized. Error from transient deviations can also be eliminated by appropriately selecting the period (the above measurement period) for which the calculation is performed.

Extra processing time is also not required to calculate the roll diameter because the roll diameter acquisition process is executed during the forward conveyance process in this printer 2.

Furthermore, because the roll diameter calculation process is executed repeated, checking for problems related to the roll diameter and roll diameter calculation is simple.

The process of calculating and storing the roll diameter is executed during each forward conveyance operation in the embodiment described above, but could be executed when the conveyance operation has been executed a predetermined number of times instead of during each forward conveyance operation. For example, the process could be executed each time the forward conveyance operation has been performed three times. This can reduce the load of the control process.

The roll diameter calculation process is executed during the forward conveyance operation in the embodiment described above, but a configuration that stores only the encoder 31 counts during the conveyance operation, and calculates and stores the roll diameter based on the stored counts when the paper 26 has stopped after the conveyance operation is completed, is also conceivable. This reduces the control process load during media conveyance.

As described with reference to FIG. 6, the roll diameter is calculated immediately before deceleration starts in the embodiment described above, but the timing when the roll diameter calculation and storage process ends is not limited to just before deceleration, and could be set to an appropriate time before or after deceleration starts.

The print medium in the foregoing embodiment is paper, but the invention is not so limited and can be used with any type of sheet medium.

The foregoing embodiment is also described with the conveyance device disposed to a printer, but conveyance devices applying the invention can be used with other devices that apply other processes to sheet media, including mechanical processes, laser processes, and fluid ejection processes.

The invention being thus described, it will be obvious that the invention can be varied in many ways. Such variations are not to be regarded as a departure from the spirit and scope of the invention, and all such modifications as would be obvious to one skilled in the art are intended to be included within the scope of the following claims.

What is claimed is:

1. A conveyance device that holds a sheet medium in a roll, the conveyance device comprising:

a drive roller that feeds the sheet medium from the roll to a conveyance path;

a roll rotating unit including a motor that rotates the roll forward to convey the sheet medium toward the drive roller in a forward conveyance operation and in reverse to rewind the sheet medium in a reverse conveyance operation;

a control unit configured to receive a conveyance command including distance data indicating a conveyance distance in the reverse conveyance operation, and to drive the motor of the roll rotating unit in the reverse conveyance operation to rewind the sheet medium;

a first rotation detection unit, disposed to the drive roller, that generates a first electronic value indicative of a rotation of the drive roller and outputs the first electronic value to the control unit; and a second rotation detection unit, disposed to the roll rotating unit, that generates a second electronic value indicative of a rotation of the roll rotating unit and outputs the second electronic value to the control unit;

wherein the control unit calculates a roll diameter of the roll based on the first electronic value and the second electronic value received during a specific period in the forward conveyance operation, and stores the calculated roll diameter as roll diameter information, wherein, when the control unit receives the conveyance command, the control unit acquires the distance data included in the received conveyance command, acquires the stored roll diameter information, and selects a drive mode, from a first drive mode and a second drive mode, for driving the motor of the roll rotating unit based on the acquired distance data and the acquired roll diameter information, wherein a speed of the motor driven in the first drive mode is greater than a speed of the motor driven in the second drive mode.

2. The conveyance device described in claim 1, wherein the drive mode is selected so that a first condition, which is that the conveyance distance indicated by the acquired distance data is greater than a total distance the sheet medium is conveyed both during acceleration and during deceleration of the motor of the roll rotating unit in the selected drive mode, is satisfied.

3. The conveyance device described in claim 2, wherein the drive mode is selected so that a second condition, which is that a conveyance speed of the motor of the roll rotating unit is lower than a conveyance speed of the drive roller in the selected drive mode, is also satisfied.

4. The conveyance device described in claim 3, wherein, from among a plurality of drive modes satisfying the first condition and the second condition, the drive mode with the highest speed of rotation of the motor is selected and set as the drive mode to be used.

5. The conveyance device described in claim 1, wherein drive mode selection information correlating the selected drive mode to the conveyance distance indicated by the acquired distance data and the stored roll diameter information is stored, and the drive mode selection information is referenced to determine the drive mode.

6. The conveyance device described in claim 1, wherein calculating the roll diameter and storing the roll diameter information comprises executing the steps of:

calculating the roll diameter based on values detected by the first rotation detection unit and second rotation detection unit during the specific period, after the second rotation detection unit detects rotation after the forward conveyance operation starts, or after the sheet medium is conveyed a predetermined conveyance distance in the forward conveyance operation, and updating the stored roll diameter information with a more recently calculated roll diameter.

7. The conveyance device described in claim 6, wherein an error process is executed when the roll diameter calculated in a current specific period is greater than the roll diameter calculated in a previous specific period or is not in a predetermined tolerance range.

8. A method for execution on a conveyance device that holds a sheet medium in a roll and includes a drive roller that feeds the sheet medium from the roll to a conveyance path, a roll rotating unit including a motor that rotates the roll forward to convey the sheet medium toward the drive roller in a forward conveyance operation and in reverse to rewind the fed sheet medium in a reverse conveyance operation, a first rotation detection unit disposed to the drive roller, and a second rotation detection unit disposed to the roll rotating unit, the method comprising:

acquiring a first electronic value indicative of rotation of the driver roller output by the first rotation detection unit;

acquiring a second electronic value indicative of rotation of the roll rotating unit output by the second rotation detection unit;

calculating the roll diameter based on the acquired first electronic value and the acquired second electronic value output during a specific period in the forward conveyance operation, and storing the calculated roll diameter as the roll diameter information;

receiving a conveyance command including distance data indicating a conveyance distance in the reverse conveyance operation;

acquiring the distance data included in the received conveyance command;

acquiring the stored roll diameter information; and selecting a drive mode, from a first drive mode and a second drive mode, for driving the motor of the roll rotating unit based on the acquired distance data and the acquired roll diameter information;

wherein the speed of the motor driven in the first drive mode is greater than the speed of the motor driven in the second drive mode.

9. The method described in claim 8, wherein the drive mode with the highest speed of rotation of the motor is selected from among a plurality of drive modes satisfying a first condition, which is that the conveyance distance indicated b the acquired distance data is greater than a total distance the sheet medium is conveyed both during acceleration and during deceleration of the motor of the roll rotating unit in the selected drive mode, and also satisfying a second condition, which is that a conveyance speed of the motor of the roll rotating unit is lower than a conveyance speed of the drive roller in the selected drive mode, and set as the drive mode to be used.

10. The conveyance method described in claim 8, wherein drive mode selection information correlating the selected drive mode to the conveyance distance indicated by the acquired distance data and the stored roll diameter information is stored, and the drive mode selection information is referenced to determine the drive mode.

11. The method described in claim 8, wherein calculating the roll diameter and storing the roll diameter information comprises executing the steps of:

calculating the roll diameter based on values detected by the first rotation detection unit and second rotation detection unit during the specific period, after the second rotation detection unit detects rotation after the forward conveyance operation starts, or after the sheet medium is conveyed a predetermined conveyance distance in the forward conveyance operation, and updating the stored roll diameter information with a more recent calculated roll diameter.

12. The conveyance method described in claim 11, wherein an error process is executed when the roll diameter calculated in a current specific period is greater than the roll diameter calculated in a previous specific period or is not in a predetermined tolerance range.

13. A conveyance device that holds a medium in a roll, the conveyance device comprising:

a drive roller configured to feed the medium from the roll;

a roll motor configured to rotate the roll;

a first rotation detector configured to output a first electronic value indicative of rotation of the drive roller;

a second rotation detector configured to output a second electronic value indicative rotation of the roll;

a controller configured to receive a conveyance command including distance data indicating a conveyance distance, drive the roll motor according to the conveyance command, and calculate a diameter of the roll based on the first electronic value and the second electronic value, wherein, when the controller receives the conveyance command, the controller acquires the distance data included in the received conveyance command, and selects a drive mode, from a first drive mode and a second drive mode, for driving the roll motor based on the acquired distance data and the calculated diameter.

* * * * *